US007303356B2

(12) United States Patent
Schennach et al.

(10) Patent No.: US 7,303,356 B2
(45) Date of Patent: Dec. 4, 2007

(54) SOIL COMPACTING DEVICE COMPRISING AN UNDERCARRIAGE

(75) Inventors: Hermann Schennach, Dietersheim (DE); Marcus Kuchler, Munich (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/518,171

(22) PCT Filed: Jun. 6, 2003

(86) PCT No.: PCT/EP03/05987

§ 371 (c)(1),
(2), (4) Date: Aug. 23, 2005

(87) PCT Pub. No.: WO03/106771

PCT Pub. Date: Dec. 24, 2003

(65) Prior Publication Data

US 2006/0083590 A1 Apr. 20, 2006

(30) Foreign Application Priority Data

Jun. 17, 2002 (DE) ..... 102 26 920

(51) Int. Cl.
*E01C 19/34* (2006.01)
*E01C 19/38* (2006.01)

(52) U.S. Cl. ..... 404/133.1; 404/133.05

(58) Field of Classification Search ..... 404/133.05, 404/133.1
See application file for complete search history.

(56) References Cited

U.S. PATENT DOCUMENTS

| | | | | |
|---|---|---|---|---|
| 3,199,424 | A | 8/1965 | Glass | |
| 3,232,188 | A | 2/1966 | Frohnauer | |
| 6,293,729 | B1 * | 9/2001 | Greppmair | 404/133.1 |
| 6,394,697 | B1 * | 5/2002 | De Boer | 404/133.1 |
| 6,409,426 | B1 * | 6/2002 | MacLellan | 404/133.1 |
| 6,551,022 | B1 * | 4/2003 | Stayner | 404/133.1 |
| 6,588,977 | B1 * | 7/2003 | Stayner | 404/133.1 |

FOREIGN PATENT DOCUMENTS

CH 321 022 A 4/1957

* cited by examiner

*Primary Examiner*—Raymond W Addie
(74) *Attorney, Agent, or Firm*—Boyle Fredrickson S.C.

(57) ABSTRACT

The invention relates to a soil compacting device, especially a vibrating plate, which comprises an undercarriage mounted on a lower body, said undercarriage having an undercarriage axle that is stationary with respect to the device. By suitably positioning the undercarriage axle it is achieved that, in a vibrating position, the rolling bodies do not touch ground while they do touch ground when the entire device is simply tilted about an axis that corresponds approximately to the undercarriage axle, thereby allowing the mobility of the device. The soil compacting device is advantageous over conventional devices in that an extension or swiveling of the undercarriage axle for the purpose of transport and the corresponding devices are no longer required.

17 Claims, 2 Drawing Sheets

SOIL COMPACTING DEVICE COMPRISING AN UNDERCARRIAGE

BACKGROUND OF THE INVENTION

1. Field of the Invention

The present invention relates to a soil compacting device according to the preamble of patent claim 1.

2. Description of the Related Art

Such a soil compacting device is for example a vibration plate in which a vibration generator, driven by a motor, produces an essentially vertically oriented vibration that loads a compacting plate. Depending on the design of the vibration generator, this generator is also suitable for moving the compacting plate forwards or backwards over the soil to be compacted, and for making the plate steerable.

Such a soil compacting device is known for example from DE 198 40 453 A1. It comprises an extendable undercarriage, so that the device can travel shorter distances on a construction site without requiring a transport vehicle.

In CH-A-321022, a vibration plate is described in which there is attached to the upper mass a pivot mechanism by which an undercarriage can be pivoted between an idle position and a travel position.

In U.S. Pat. No. 3,199,424, a vibration plate is indicated in which an undercarriage is fastened rigidly to a guide rod that is fastened to an upper mass of the vibration plate and that can be pivoted relative thereto.

From DE-U-85 13 149, a vibration plate is known having a lower mass comprising a compacting plate, an upper mass connected with the lower mass via a spring, a vibration generator that loads the compacting plate, and an undercarriage having roller elements situated in rotatable fashion on an undercarriage axle for the transporting of the device, the undercarriage axle being stationary in relation to the device, and the undercarriage being attached to the lower mass.

In addition, vibration plates are known, such as the AVP 2920 of the AMMANN company, in which an undercarriage is provided with a pivot mechanism that can move wheels from a rest position into a travel position. However, the pivot mechanism has an expensive construction, in order to avoid wear on the pivot bearings due to the vibrations that occur.

In the cited vibration plate, the pivot mechanism is fastened to the upper mass or drawbar. In these constructive forms, in contrast, in the travel position the wheels are situated under the compacting plate. Due to the situation of the drawbar and a very large distance of the center of gravity of the overall system from the rotational axle of the wheels, the travel behavior is not very satisfactory. For larger compacting plates in particular, strong holding forces are necessary to prevent the plate from making a tipping movement in the direction of travel about the wheel rotational axle. The installation of the undercarriage in its travel position often presents problems for the user, because in most cases a series of hand grips has to be provided. This entails a risk of injury to the user if the installation is not executed correctly.

The present invention is based on the object of indicating a soil compacting device comprising an undercarriage, in which the above-described disadvantages are avoided.

OBJECTS AND SUMMARY OF THE INVENTION

The solution of this problem according to the present invention is indicated in patent claim 1. Advantageous further developments of the present invention are indicated in the dependent claims.

A soil compacting device according to the present invention, having a lower mass comprising a compacting plate, an upper mass connected with the lower mass via a spring damping device, a vibration generator that loads the compacting plate, and an undercarriage having one or more roller elements situated in rotatable fashion on an undercarriage axle for the transport of the device, is characterized in that the undercarriage axle is stationary with respect to the device.

In comparison with conventional devices, the fact that the undercarriage axle is stationary with respect to the device means that the roller elements are already in their travel position during vibration operation. In this way, an extending or pivoting of the undercarriage axle is not required for transport, and a part of the mechanism that is particularly susceptible to wear, namely the extension or pivoting mechanism, is omitted, resulting in lower purchasing costs, less failure time, lower maintenance costs, and greater ease in operating the soil compacting device.

If, according to a particularly advantageous specific embodiment of the present invention, the undercarriage is fastened to the lower mass, this reduces the distance of the center of gravity of the overall system from the undercarriage axle. In this way, the travel behavior of the device in transport operation is improved.

The soil compacting device can be constructed in particularly advantageous fashion by selecting, for a given diameter of the roller element, the axial position of the undercarriage axle in such a way that in a vibrating position the compacting plate makes flat contact with the soil and the roller elements do not touch the soil. In a transport position, in contrast, the compacting plate does not touch the soil, but the roller elements touch the soil and bear the weight of the device. A changeover between the vibrating position and the transport position is possible by tipping the overall device about an axis that corresponds essentially to the undercarriage axle.

A further advantage results from the addition of an intentional imbalance weight to the roller elements. This has the effect that the roller elements exhibit the tendency to rotate by themselves when the compacting plate vibrates, so that the bearings carrying the roller elements are not stressed in punctiform fashion; in this way it is even possible to use roller bearings.

These and additional advantages and features of the present invention are explained in more detail in the following on the basis of a preferred specific embodiment, with the aid of the accompanying Figures.

BRIEF DESCRIPTION OF THE DRAWINGS

FIGS. 1 to 4 essentially show the same soil compacting device according to the present invention from different angles of view and in different operating states. Because the Figures designate the same subject matter, they are also described together.

DETAILED DESCRIPTION OF THE PREFERRED EMBODIMENTS

Figure 1:
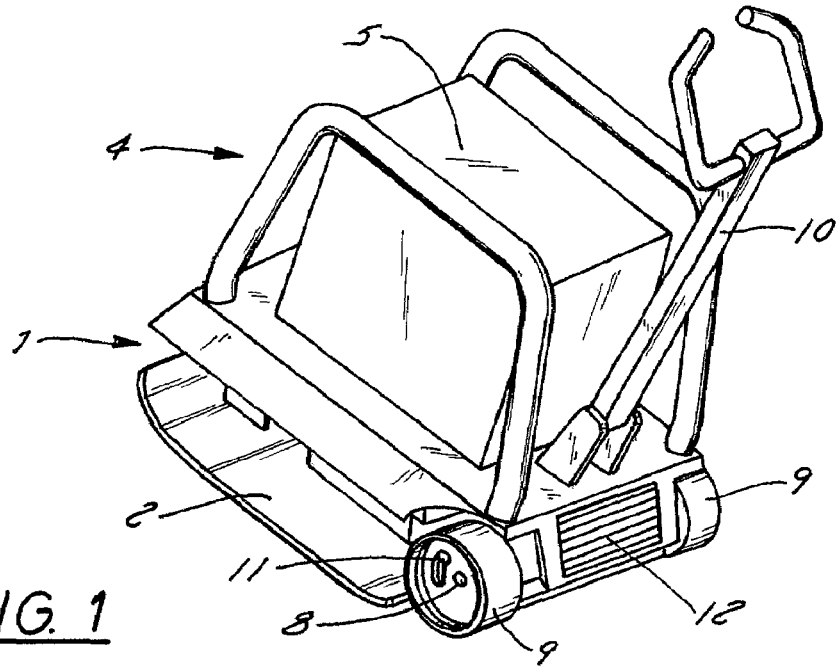
FIG. 1 shows a perspective view of a soil compacting device according to the present invention in the transport position.

A drive unit associated with an upper mass 4 and hidden under a covering 5 is positioned on a compacting plate 2 associated with a lower mass 1, coupled via a spring damping device 3.

The drive, which is standardly a gasoline or diesel engine, drives a vibration generator 6 that is coupled with compacting plate 2 in such a way that the vibrations produced by vibration generator 6 are transmitted directly to compacting plate 2, and thus into the soil to be compacted.

Undercarriage 7 comprises an undercarriage axle 8 that is stationary in relation to the soil compacting device, about which one or more roller elements 9 are situated so as to be capable of rotation. In the embodiment shown here, which is particularly advantageous, undercarriage 7 is attached to lower mass 1, in particular to compacting plate 2. This reduces the distance of the center of gravity of the overall device from undercarriage axle 8, resulting in an improvement of the travel behavior of the device in transport operation. Moreover, the tendency of heavy compacting plates to tip about the undercarriage axle in the direction of travel during transport is reduced.

Figure 2:
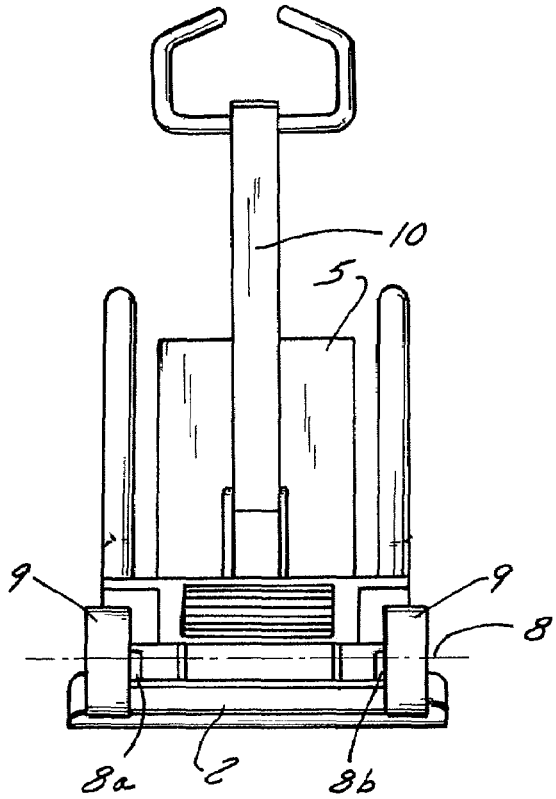
FIG. 2 shows a rear view of the soil compacting device in the vibrating position.
Figure 4:
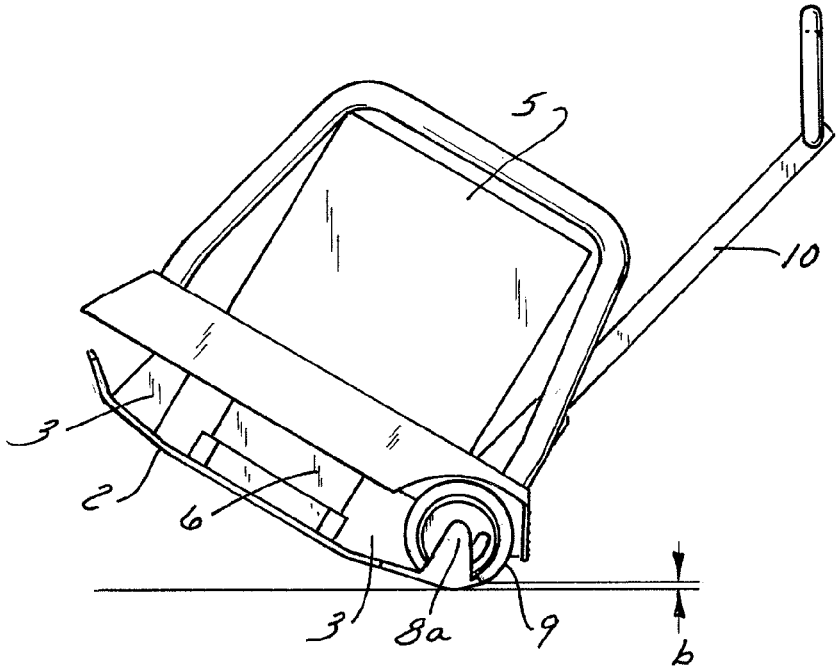
FIG. 4 shows a side view of the soil compacting device in the transport position.

The undercarriage axle can consist of an actual component; however, it can also be a fictive axle of rotation formed by bearer elements 8*a*, 8*b* that are fastened to compacting plate 2 and that bear roller elements 9 (FIGS. 2 and 4).

Figure 3:
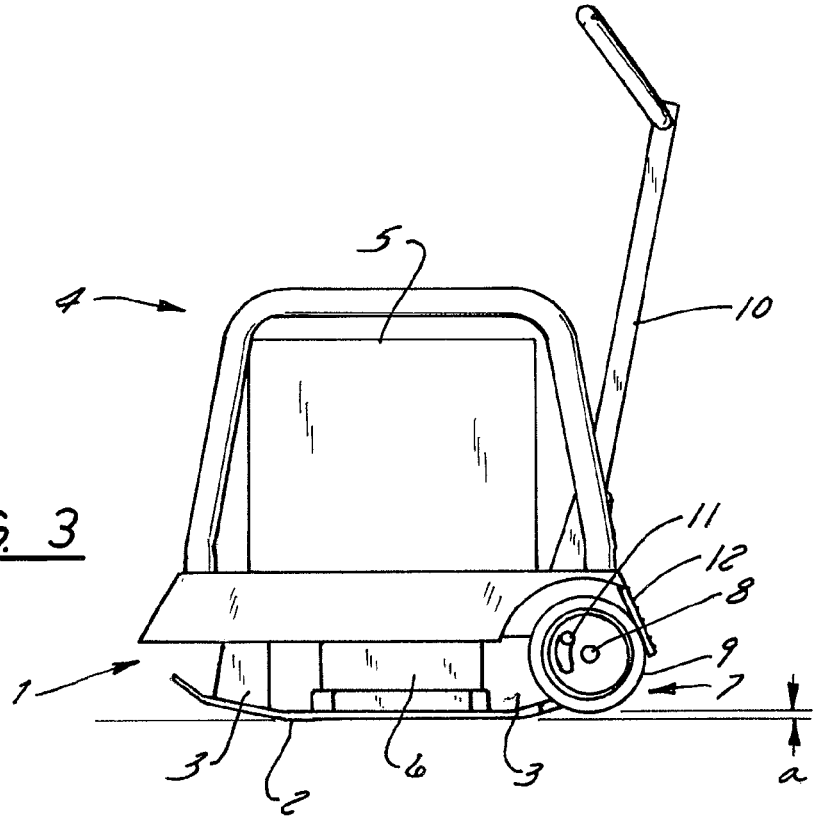
FIG. 3 shows a side view of the soil compacting device in the vibrating position.

For a given diameter of roller elements 9, the axial position of undercarriage axle 8 is selected such that in a vibrating position (FIG. 3) compacting plate 2 makes flat contact with the soil and roller elements 9 do not touch the soil, while in a transport position (FIG. 4) compacting plate 2 does not touch the soil, but roller elements 9 touch the soil and bear the weight of the device. A changeover between the two positions is possible by tipping the overall device about an axis that corresponds essentially to undercarriage axle 8. For example, here the change from the vibrating position into the transport position is possible by a simple tipping away of compacting plate 2 in the direction of a drawbar 10.

In addition, it is advantageous to select the axial position of undercarriage axle 8 and the size of roller elements 9 in such a way as to achieve a distance a between a soil contact surface of compacting plate 2 and the lowest point of roller element 9 in the vibrating position, as well as a distance b by which, in the transport position, roller elements 9 extend past what is then the lowest point of soil compacting plate 2. Given a sufficiently large distance b, the soil compacting device can then easily travel even over uneven soil, whereby at the same time distance a must be selected such that it is ensured that in vibrating operation roller elements 9 do not touch the soil.

Undercarriage axle 8 is situated above compacting plate 2, making possible an advantageous relation between the effective line of the tensile force exerted by the user on drawbar 10, the center of gravity of the overall device, and the position of undercarriage axle 8, so that a high degree of travel comfort is achieved without a tendency to tip in the direction of travel.

Because the situation of undercarriage 7 on lower mass 1, and in particular also on compacting plate 2, also loads roller elements 9 with a high degree of acceleration, it is recommended to provide roller elements 9 with an intentional imbalance 11, so that during vibration they develop the tendency to rotate by themselves about undercarriage axle 8. This helps to counteract a punctiform wearing of the roller element bearings. In particular, this makes it suitable to use roller bearings for roller elements 9.

In addition, the embodiment shown here comprises a step surface 12 for supporting the moment required for the changeover of the positions laterally on upper mass 4, so that, for example, the user can put the device in the travel position, or the transport position, by loading step surface 12 with his foot and tipping drawbar 10 back. This type of changeover from the vibrating position into the transport position and vice versa entails a significantly lower risk of injury in comparison with soil compacting devices having pivotable or extendable undercarriages, and can be accomplished very quickly, because no modification of the undercarriage is required.

We claim:

1. A soil compacting device comprising:

a lower mass that comprises a compacting plate, an upper mass connected with the lower mass via a spring damping device, a vibration generator that loads the compacting plate, and an undercarriage having one or more roller elements situated in rotatable fashion on an undercarriage axle for the transport of the device, wherein the undercarriage axle is stationary in relation to the device; such that the rolling elements are positioned, at least in part, in front of a rear edge of the compacting plate, and the rolling elements are positioned at least in part, in a notch in a respective rear corner of the compacting plate;

the undercarriage is attached to the lower mass; and wherein in a transport position, the compacting plate does not touch the soil, but the roller elements touch the soil and bear the weight of the device.

2. The soil compacting device as claimed in claim 1, wherein, for a given roller element diameter, the axial position of the undercarriage axle is selected in such a way that in a vibrating position, the compacting plate makes flat contact with the soil and the roller elements do not touch the soil, and a changeover between the two positions being possible by tipping the overall device about an axis that corresponds essentially to the undercarriage axle.

3. The soil compacting device as claimed in claim 2, wherein the axial position of the undercarriage axle and the size of the roller elements are selected such that in the vibrating position, there is a distance (a) between a soil contact surface of the compacting plate and the lowest point of the roller elements, and a distance (b) results by which, in the transport position, the roller elements extend past what is then the lowest point of the compacting plate.

4. The soil compacting device as recited in claim 1, wherein the undercarriage axle is situated above the compacting plate.

5. The soil compacting device as recited in claim 2, wherein a step surface is laterally present on the upper mass for the supporting of a moment required for the change of positions.

6. The soil compacting device as claimed in claim 3, wherein a step surface is laterally present on the upper mass for the supporting of a moment required for the change of positions.

7. The soil compacting device as recited in claim 1, wherein the undercarriage axle comprises bearer elements fastened to the compacting plate.

8. A soil compacting device comprising:

a lower mass including a compacting plate;

an upper mass;

a spring damping device coupling the lower mass to the upper mass;

a vibration generator that generates vibrations in the compacting plate;

an undercarriage attached to the lower mass;

an undercarriage axle on the undercarriage; and at least one roller element that is mounted on the undercarriage via the undercarriage axle for transporting the soil compacting of device, the rolling elements are positioned, at least in part, in front of a rear edge of the compacting plate, wherein the undercarriage axle is stationary in relation to the undercarriage, and wherein the soil compacting device can assume a transport position in which the compacting plate is spaced from the soil and the entire weight of the compacting device is borne by the at least one roller element.

9. The soil compacting device as claimed in claim 8, wherein, in a vibrating position of the compacting device, the compacting plate makes flat contact with the soil and the at least one roller elements does not touch the soil, and wherein the compacting device is changed over between the vibrating position and the transport position by tipping the compacting device about an axis that corresponds at least essentially to the undercarriage axle axis.

10. The soil compacting device as claimed in claim 9, wherein in the vibrating position of the compacting device, there is a distance (a) between a soil contact surface of the compacting plate and the lowest point of the roller elements, and a distance (b) results by which, in the transport position, the roller elements extend past what is then the lowest point of the compacting plate.

11. The soil compacting device as recited in claim 8, wherein the undercarriage axle is situated above the compacting plate.

12. The soil compacting device as recited in claim 9, wherein a step is laterally present on the upper mass for supporting a moment that effects the change between the transport and vibrating positions of the compacting device.

13. The soil compacting device as claimed in claim 10, wherein a step is laterally present on the upper mass for supporting a moment that effects the change between the transport and vibrating positions of the compacting device.

14. The soil compacting device as claimed in claim 8, wherein two rolling elements are provided, each of which is positioned, at least in part, in a notch in a respective rear corner of the compacting plate.

15. The soil compacting device as recited in claim 8, wherein the undercarriage axle comprises bearer elements fastened to the compacting plate.

16. A soil compacting device comprising:

a lower mass that comprises a compacting plate, an upper mass connected with the lower mass via a spring damping device, a vibration generator that loads the compacting plate, and an undercarriage having one or more roller elements situated in rotatable fashion on an undercarriage axle for the transport of the device, wherein the undercarriage axle is stationary in relation to the device;

the undercarriage is attached to the lower mass;

in a transport position, the compacting plate does not touch the soil, but the roller elements touch the soil and bear the weight of the device; and wherein the roller elements have an intentional imbalance.

17. A soil compacting device comprising:

a lower mass including a compacting plate;

an upper mass;

a spring damping device coupling the lower mass to the upper mass;

a vibration generator that generates vibrations in the compacting plate;

an undercarriage attached to the lower mass;

an undercarriage axle on the undercarriage; and at least one roller element that is mounted on the undercarriage via the undercarriage axle for transporting the soil compacting of device, wherein the undercarriage axle is stationary in relation to the undercarriage, wherein the soil compacting device can assume a transport position in which the compacting plate is spaced from the soil and the entire weight of the compacting device is borne by the at least one roller element, and wherein the at least one roller element has an intentional imbalance.

* * * * *